US008210644B2

(12) United States Patent
Tsukada

(10) Patent No.: US 8,210,644 B2
(45) Date of Patent: Jul. 3, 2012

(54) LIQUID EJECTING APPARATUS AND METHOD FOR CLEANING THE SAME

(75) Inventor: Kenji Tsukada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 1180 days.

(21) Appl. No.: 11/622,892

(22) Filed: Jan. 12, 2007

(65) Prior Publication Data

US 2008/0007591 A1 Jan. 10, 2008

Related U.S. Application Data

(62) Division of application No. 10/601,200, filed on Jun. 23, 2003, now Pat. No. 7,175,254.

(30) Foreign Application Priority Data

Jun. 21, 2002 (JP) ..... P2002-181654
Jun. 21, 2002 (JP) ..... P2002-181655
Jun. 17, 2003 (JP) ..... P2003-172520

(51) Int. Cl.
*B41J 2/165* (2006.01)

(52) U.S. Cl. ..... 347/33

(58) Field of Classification Search ..... None
See application file for complete search history.

(56) References Cited

U.S. PATENT DOCUMENTS 6,371,595 B1 4/2002 Takemoto et al.
6,467,873 B1 * 10/2002 Toba et al. ..... 347/33
6,565,183 B2 * 5/2003 Goto et al. ..... 347/22
6,679,578 B2 * 1/2004 Arakawa ..... 347/33
2002/0105560 A1 8/2002 Shimizu et al.
2004/0130588 A1 7/2004 Nakagawa et al.

FOREIGN PATENT DOCUMENTS

JP 05201012 A 8/1993
JP 7-214785 A 8/1995
JP 11-342631 A 12/1999
JP 2000-103071 A 4/2000
JP 2002-052728 A 2/2002
JP 2002-079680 A 3/2002
JP 2002-160377 A 6/2002

* cited by examiner

*Primary Examiner* — Matthew Luu
*Assistant Examiner* — Alejandro Valencia
(74) *Attorney, Agent, or Firm* — Sughrue Mion, PLLC

(57) ABSTRACT

A liquid ejecting apparatus includes a liquid ejecting head having a plurality of nozzles for ejecting a liquid drop formed at a lower face thereof, a wiping member wiping an opening portion of the nozzle, a carriage mounted with the liquid ejecting head, and moving in a horizontal direction relative to the wiping member; and an inclined plate mounted on the carriage at a predetermined space from the liquid ejecting head, and formed with an inclined face having a rising inclination as being far from the liquid ejecting head. A projected portion is provided on at least one of the liquid ejecting head and the inclined plate such that an opening portion at a lower side of the space is smaller than an upper portion of the space.

4 Claims, 10 Drawing Sheets

LIQUID EJECTING APPARATUS AND METHOD FOR CLEANING THE SAME

CROSS-REFERENCE TO RELATED APPLICATIONS

This is a Divisional Application of U.S. application Ser. No. 10/601,200 filed Jun. 23, 2003; the entire disclosure of which is incorporated herein by reference.

BACKGROUND OF THE INVENTION

The present invention relates to a liquid ejecting apparatus and a cleaning method thereof, particularly, relates to a liquid ejecting apparatus in which a liquid ejecting head is mounted on a carriage, and the liquid ejecting head ejects a liquid to a target by moving the carriage relative to the target and a cleaning method for cleaning the liquid ejecting apparatus.

For example, there is an ink jet type printer for printing by ejecting a plurality of ink drops as an apparatus for ejecting an extremely small amount of a liquid to a target. The printer of this kind is provided with a recording head formed with a plurality of nozzles each having a very small opening portion and each ink drop is ejected from the opening portion of each nozzle. Further, the printer is provided with a wiping member for maintenance cleaning. In finishing the maintenance cleaning, the wiping member slides on a lower face of the recording head so that ink adhered to the opening portion of the nozzle and a surrounding thereof is wiped, extra ink adhered to the lower face is removed, and a meniscus of ink at a front end portion of the nozzle is regulated.

However, the wiping member is ordinarily constituted by an elastic member. The wiping member is bent (in order to sufficiently remove ink) when sliding on the opening portion of the nozzle. Therefore, when the wiping member wipes the opening portion of the nozzle and is moved away from the recording head, the wiping member rapidly restores by a restoring force thereof. That is, when the wiping member restores from a bent state, ink adhered to a front end of the wiping member scatters to the surrounding by the restoring operation so as to contaminate the surrounding, that is, an inner side of the printer.

Also, in order to reduce contamination by ink scattered from the front end of the wiping member, there is emerged a printer provided with an inclined plate for restoring the wiping member which has wiped the recording head gradually to an original shape at a carriage. That is, the inclined plate has an inclined face. The wiping member gradually restores to the original shape along the inclined face and therefore, scattering of ink can be reduced.

However, the inclined plate is attached to the carriage at a clearance from the recording head to facilitate integration thereof. When the wiping member restores to the original shape is a case in which the front end of the wiping member is brought into the clearance, ink is scattered to the clearance between the inclined plate and the recording head over a wide range. Hence, when the clearance is narrowed such that the wiping member is prevented from being brought between the inclined plate and the recording head, in this case, since the clearance is narrow, capillary force is operated, ink invaded to the clearance by movement of the wiping member is conducted to an upper portion, for example, conducted to other portion of a board of the printer or the like to thereby bring about a drawback.

SUMMARY OF THE INVENTION

It is therefore the first object of the present invention to provide a liquid ejecting apparatus capable of reducing invasion of a liquid between a liquid ejecting head and an inclined plate, further, when the liquid invades between the liquid ejecting head and the inclined plate, preventing the liquid from conducting to other portion.

Also, it is the second object of the present invention to provide a liquid ejecting apparatus and a cleaning method capable of restraining a liquid from being scattered by a wiping member which has finished wiping an opening portion of a nozzle to thereby less contaminate an inner portion thereof.

In order to achieve the above objects, according to the present invention, there is provided a liquid ejecting apparatus comprising:

a liquid ejecting head, having a plurality of nozzles for ejecting a liquid drop formed at a lower face thereof;

a wiping member, wiping an opening portion of the nozzle;

a carriage, mounted with the liquid ejecting head, and moving in a horizontal direction relative to the wiping member; and an inclined plate, mounted on the carriage at a predetermined space from the liquid ejecting head, and formed with an inclined face having a rising inclination as being far from the liquid ejecting head, wherein a projected portion is provided on at least one of the liquid ejecting head and the inclined plate such that an opening portion at a lower side of the space is smaller than an upper portion of the space.

In the above configuration, the opening portion of the space between the liquid ejecting head and the inclined plate is narrowed and therefore, it is difficult for the liquid to invade the space via the opening portion. Further, the opening portion is narrowed, a clearance at an upper portion thereof is widened and therefore, it is reduced that the liquid invading the space is conducted to the upper portion of the predetermined space by the capillary force to bring about a drawback in other portion. Therefore, a drawback by the liquid invading the space between the liquid ejecting head and the inclined plate can be reduced while facilitating to integrate the inclined plate to the carriage.

Preferably, a lower face of the inclined plate on a side of the liquid ejecting head and a lower face of the liquid ejecting head on a side of the inclined plate are substantially flush with each other.

In the above configuration, the lower face of the inclined plate on the side of the liquid ejecting head and the lower face of the liquid ejecting head on the side of the inclined plate are made to be substantially flush with each other. Therefore, there is hardly a stepped difference between the liquid ejecting head and the inclined plate and when the wiping member is moved from the liquid ejecting head to the inclined plate, it is reduced that the liquid adhered to the front end scatters by impact of the stepped difference. Therefore, a possibility of invasion of the liquid to the space by the scattering can be reduced.

Preferably, a clearance of the opening portion of the space is smaller than a width of the wiping member in the horizontal direction.

In the above configuration, the clearance of the opening portion of the predetermined space is smaller than the width of the wiping member in the horizontal direction and therefore, a possibility of fitting the wiping member to the clearance and scattering the liquid adhered to the front end to the predetermined space can be reduced. Therefore, the possibility of invasion of the liquid to the predetermined space can further be reduced.

Preferably, the inclined plate is formed with a discharge hole communicating the space with an external portion to penetrate a base end portion of the projected portion and a lower face thereof.

In the above configuration, the inclined plate is formed with the discharge hole communicating the space and the external portion to penetrate the base end portion and the lower face of the projected portion and therefore, when a large amount of the liquid invades the space, the invaded liquid can be discharged to the external portion via the discharge hole. Therefore, the large amount of the liquid invading the space can easily and smoothly be discharged via the discharge hole and therefore, the drawback brought about by conducting the liquid to the upper portion can further be reduced.

According to the present invention, there is also provided a liquid ejecting apparatus comprising:

a liquid ejecting head, having a plurality of nozzles for ejecting a liquid drop formed at a lower face thereof;

a wiping member, wiping an opening portion of the nozzle;

a carriage, mounted with the liquid ejecting head, and moving in a horizontal direction relative to the wiping member; and an inclined plate, mounted on the carriage at a predetermined space from the liquid ejecting head, and formed with an inclined face having a rising inclination as being far from the liquid ejecting head, wherein a projected portion for adhering or repelling the liquid invading the space is provided on at least one of the liquid ejecting head and the inclined plate.

In the above configuration, the liquid which is going to invade the predetermined space between the liquid ejecting head and the inclined plate is adhered to or repelled by the projected portion for preventing invasion of the liquid and therefore, invasion of the liquid to the upper portion of the space can be prevented as less as possible. Therefore, it is reduced that the liquid invades via the clearance produced between the inclined plate and the liquid ejecting head for facilitating to integrate and it is reduced that the liquid is conducted to the upper portion of the space to bring about a drawback at other portion. Therefore, the drawback by the liquid invading the space between the liquid ejecting head and the inclined plate can be reduced while facilitating to integrate the inclined plate to the carriage.

Preferably, the projected portion is provided on the inclined plate; and wherein the projected portion is provided on the liquid ejecting head so as to overlap a clearance between the projected portion of the inclined plate and the liquid ejecting head as viewed in an extending direction of the space.

Preferably, wherein the projected portion is provided on the liquid ejecting head; and wherein the projected portion is provided on the inclined plate so as to overlap a clearance between the projected portion of the liquid ejecting head and the inclined plate as viewed in an extending direction of the space.

In the above configuration, the liquid invading via the clearance between the projected portion for preventing invasion of the liquid of the inclined plate and the liquid ejecting head is adhered to or repelled by the projected portion for preventing invasion of the liquid of the liquid ejecting head, the liquid invading via the clearance between the projected portion for preventing invasion of the liquid of the liquid ejecting head and the inclined plate is adhered to or repelled by the projected portion for preventing invasion of the liquid of the inclined plate and therefore, invasion of the liquid to the upper portion of the space can further be reduced.

According to the present invention, there is also provided a liquid ejecting apparatus comprising:

a liquid ejecting head, having a plurality of nozzles for ejecting a liquid drop formed at a lower face thereof;

a wiping member, wiping an opening portion of the nozzle;

a carriage, mounted with the liquid ejecting head, and moving in a horizontal direction relative to the wiping member; and an inclined plate, mounted on the carriage at a predetermined space from the liquid ejecting head, and formed with an inclined face having a rising inclination as being far from the liquid ejecting head, wherein an absorbing member is arranged at the space.

In the above configuration, the absorbing material is arranged at the space and therefore, the liquid invading the space can be adsorbed by the absorbing member. Therefore, invasion of the liquid to the upper portion of the space can be prevented as less as possible and it can be reduced as less as possible that in order to facilitate integration, the liquid invading the space between the liquid ejecting head and the lined plate is moved to other portion to thereby bring about a drawback at the other portion.

Preferably, the absorbing member is comprised of a porous material; and wherein the absorbing member is arranged to the space by contracting a lower portion thereof.

In the above configuration, the absorbing member arranged at the space includes the porous material, a lower portion thereof is arranged in a compressed state and therefore, the adsorbed liquid is gathered to the lower portion by the capillary force. Therefore, it is further reduced that the liquid invading the space spreads to other portion and the drawback can further be reduced from being brought about.

According to the present invention, there is also provided a liquid ejecting apparatus comprising:

a liquid ejecting head, having a plurality of nozzles for ejecting a liquid drop formed at a lower face thereof;

a wiping member, wiping an opening portion of the nozzle;

a carriage, mounted with the liquid ejecting head, and moving in a horizontal direction relative to the wiping member; and an inclined plate, mounted on the carriage at a predetermined space from the liquid ejecting head, and formed with an inclined face having a rising inclination as being far from the liquid ejecting head, wherein a hermetically sealed material is arranged at the space.

In the above configuration, the hermetically sealed material is arranged at the predetermined space and therefore, the liquid invading the predetermined space is prevented from invading by the hermetically sealed material. Therefore, the liquid can be prevented from invading the upper portion of the space as less as possible and it can be reduced as less as possible that in order to facilitate integration, the liquid invading the space between the liquid ejecting head and the inclined plate is moved to other portion to bring about a drawback at the other portion.

According to the present invention, there is also provided a liquid ejecting apparatus comprising:

a liquid ejecting head, having a plurality of nozzles for ejecting a liquid drop;

a wiping member, wiping an opening portion of the nozzle;

a carriage, mounted with the liquid ejecting head, and moving in a horizontal direction relative to the wiping member; and a controller, stops a movement of the wiping member relative to the carriage for a predetermined time period in a state that the wiping member is brought into press contact with the liquid ejecting head after wiping the liquid ejecting head.

In the above configuration, the wiping member is temporarily stopped in a state of being brought into press contact therewith after wiping the nozzle. That is, by temporarily stopping the wiping member, before the wiping member is released from the state of being brought into press contact therewith, the liquid adhered to the wiping member by the wiping operation flows down. Therefore, when the wiping member restores by being released from the state of being brought into press contact therewith, the liquid hardly adheres to the front end of the wiping member. Therefore, scattering of the liquid to the surrounding by impact of restoring the wiping member from the state of being brought into press contact therewith can be reduced and contamination of the inner portion of the liquid ejecting apparatus can further be reduced.

Preferably, an inclined plate is mounted on the carriage, and is formed with an inclined face having a rising inclination as being far from the liquid ejecting head; and wherein the controller temporarily stops the movement of the wiping member relative to the carriage in a state that the wiping member is brought into press contact with the inclined plate after wiping the liquid ejecting head.

In the above configuration, the wiping member is stopped in the state of being brought into press contact with the plate provided at the carriage and therefore, a total of the liquid ejecting head can firmly and easily be wiped. Further, a side of the liquid ejecting head of the plate constitutes a lowermost portion and therefore, the liquid adhered to the plate is gathered to the side of the liquid ejecting head. Therefore, the liquid adhered to the front end of the wiping member can sufficiently be made to flow down by stopping in a state of being brought into press contact with the upper portion of the plate after sufficiently removing the liquid of the plate which is gathered to the side of the liquid ejecting head. Therefore, when the liquid is injected from the liquid ejecting head, the liquid can further firmly be prevented from dropping from the plate to the target.

Preferably, the wiping member is comprised of an elastic material;

wherein the wiping member has a wiping face for wiping the opening portion of the nozzle, the wiping face being inclined relative to the horizontal direction by a predetermined angle.

In the above configuration, the wiping face of the wiping member is arranged skewedly to the horizontal direction in which the wiping member moves relative to the carriage. Therefore, the wiping member gradually wipes the lower face of the liquid ejecting head by being brought into press contact with the liquid ejecting head and therefore, load applied to the wiping member can be reduced in starting to wipe ink and the wiping member can be used for a longer period of time.

Preferably, the wiping member is moved relative to the carriage in a second horizontal direction substantially orthogonal to the horizontal direction after the movement of the wiping member is stopped for the predetermined time period in a state that the wiping member is brought into press contact with the liquid ejecting head.

In the above configuration, the wiping member is moved relatively in the second horizontal direction substantially orthogonal to the horizontal direction by constituting the front face by the wiping face arranged skewedly to the horizontal direction. Therefore, even when movement in the horizontal direction of the wiping member relative to the carriage is reduced, a large portion thereof can be wiped.

Here, it is preferable that, the wiping member has a rectangular shape in a horizontal section; and wherein a longitudinal direction of the rectangular shape of the wiping member is substantially in orthogonal to the horizontal direction.

In the above configuration, the wiping member is drawn in the longitudinal direction of the rectangular shape and therefore, that is, the wiping member is not released from the state of being brought into press contact therewith in one motion but is released gradually and therefore, scattering of the liquid forcedly in wide range is reduced and contamination can be restrained to a smaller range.

Preferably, the wiping member is comprised of an elastic member;

wherein the wiping member is moved in a direction substantially orthogonal to a direction in which the wiping member is bent after the predetermined time period is passed in the state that the wiping member is brought into press contact with the liquid ejecting head such that the wiping member is released from the press contact state.

In the above configuration, the wiping member is stopped for a predetermined time period in the state of being brought into press contact therewith and thereafter moved in a direction substantially orthogonal to a direction of being bent when brought into press contact therewith and released from the press contact state. Therefore, the press contact state is not released in a direction of bending the wiping member and a direction opposed thereto, that is, the state of being bent is not released in one motion but is gradually released and therefore, scattering the liquid forcedly by forcedly restoring the bent state can be restrained.

Preferably, a front end of the wiping member has a tapered shape.

In the above configuration, the front end of the wiping member is constituted by the tapered shape and therefore, the liquid adhered to the liquid ejecting head can sufficiently be wiped by bringing the front end into press contact with the liquid ejecting head and the like.

According to the present invention, there is also provided A method for cleaning, comprising the steps of:

providing a liquid ejecting head having a plurality of nozzles for ejecting a liquid drop;

providing a carriage mounted with the liquid ejecting head;

providing a wiping member;

moving the carriage in a horizontal direction relative to the wiping member;

wiping an opening portion of the nozzle by the wiping member; and stopping a movement of the wiping member relative to the carriage for a predetermined time period in a state that the wiping member is brought into press contact with the liquid ejecting head after the wiping step.

Preferably, the method further comprises the steps of:

providing a plate mounted on the carriage, and having an inclined face in which a lower portion is arranged on a side of the liquid ejecting head thereof;

stopping a movement of the wiping member relative to the carriage in a state that the wiping member is brought into press contact with the plate after the wiping step.

Preferably, the cleaning method further comprises the step of moving the wiping member relative to the carriage in a direction substantially orthogonal to the horizontal direction so that the wiping member is released from the state of being brought into press contact with the liquid ejecting head.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

First Embodiment

A first embodiment of a liquid ejecting apparatus embodying the invention will be explained in reference to FIG. 1 through FIG. 4 as follows.

Figure 1:
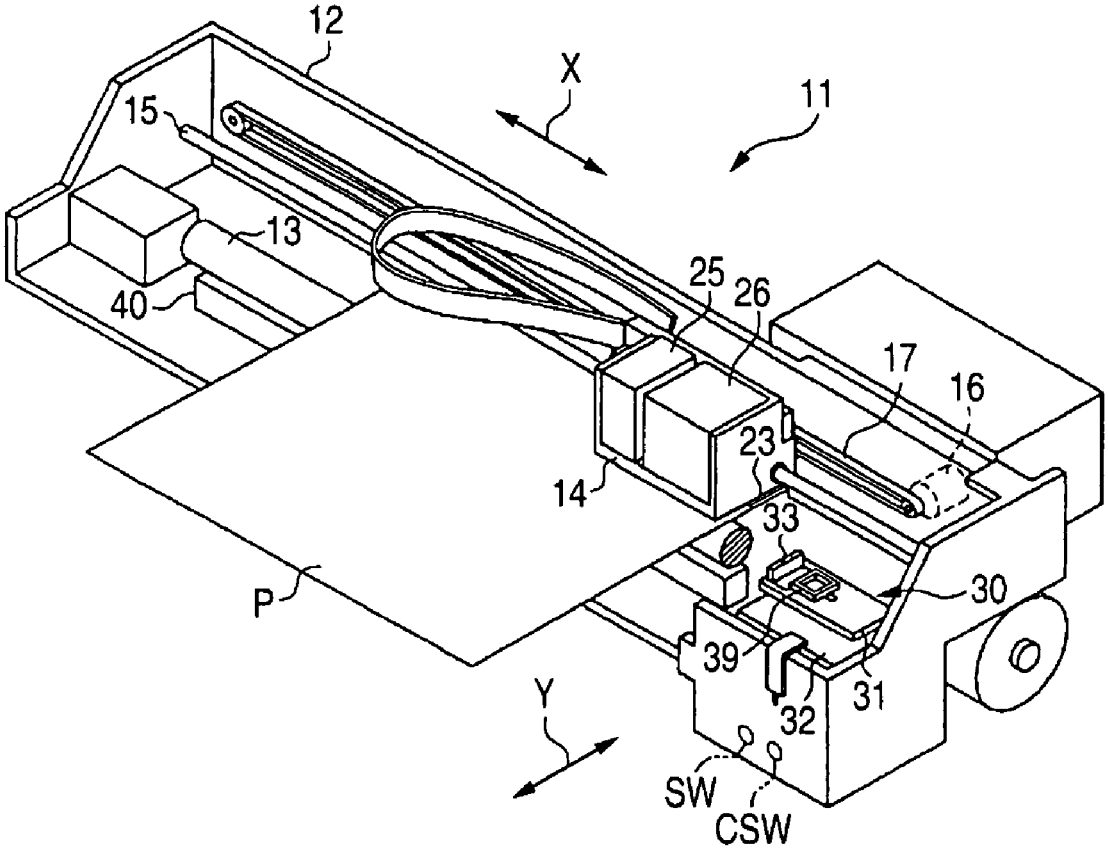
FIG. 1 is an outline perspective view of a total of a printer according to a first embodiment.

As shown in FIG. 1, according to an ink jet type printer 11 (hereinafter, referred to as printer) as a liquid ejecting apparatus of the present invention, a platen 13 is mounted on a frame 12 thereof and paper P as a target is fed onto the platen 13 by a paper feeding mechanism, not illustrated. A carriage 14 is supported by the frame 12 movably in an axial direction of the platen 13 via a guide member 15 and is reciprocated in X direction (horizontal direction) by a carriage motor 16 via timing belt 17.

Figure 2:
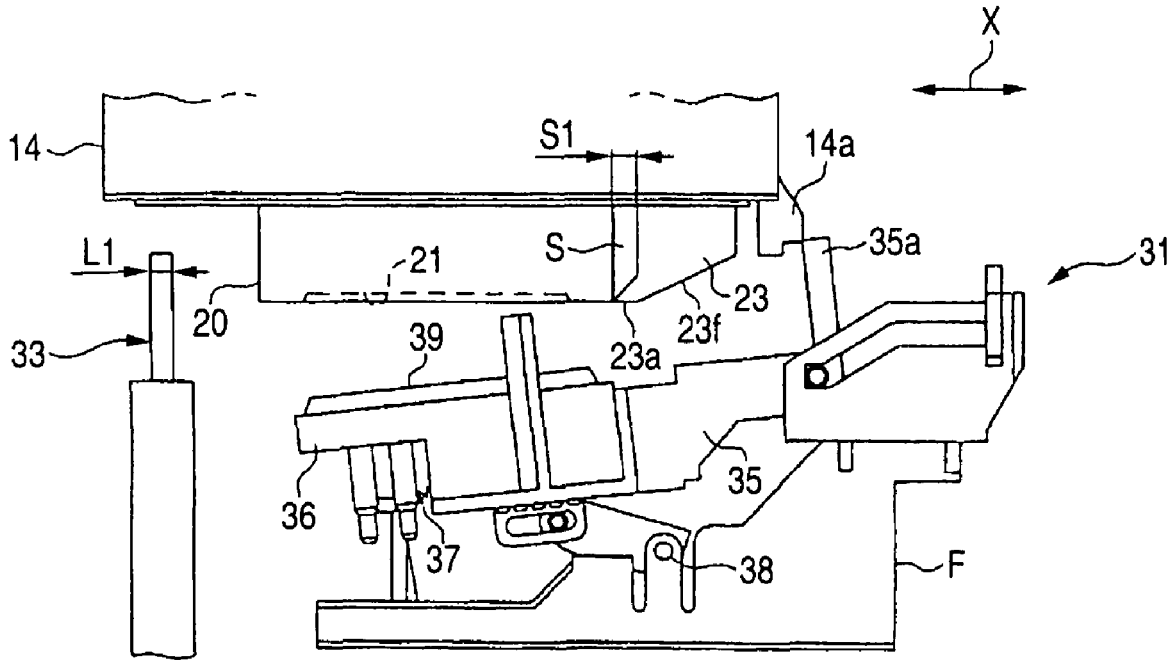
FIG. 2 is a front view of an essential portion of a head cleaning mechanism of the printer of FIG. 1.

Further, as shown in FIG. 2, a recording head 20 as a liquid ejecting head is mounted on the carriage 14. The recording head 20 has a plurality of nozzles and provided with a nozzle plate portion 21 at which respective opening portions of the nozzles are gathered at a center of a lower face thereof. The recording head 20 ejects an ink drop from the opening portion of each nozzle by driving a piezoelectric element, not illustrated.

Figure 3:
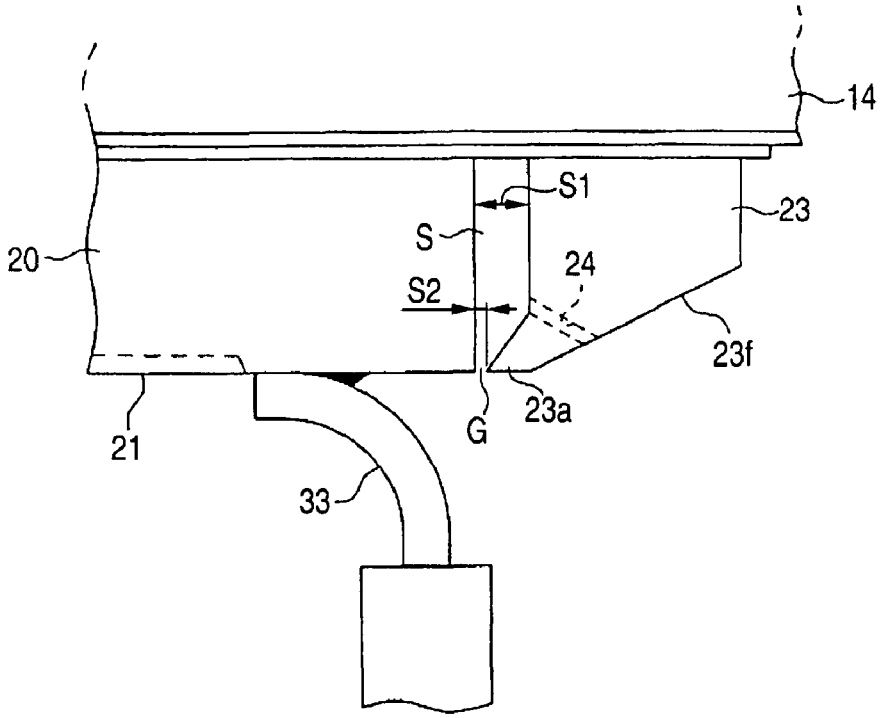
FIG. 3 is an enlarged view of a portion of an essential portion for explaining operation of a wiping member of the head cleaning mechanism of FIG. 2.

An inclined plate 23 is attached to a lower face of the carriage 14 at a clearance S1 (for example, about 3 mm) from the recording head 20 on the right side of FIG. 2. A lower face of the inclined plate 23 constitutes an inclined face 23*f*, and the inclined face 23*f* is provided with an inclination which rises as departing from the recording head in a horizontal direction (as progressing to the right side of FIG. 2). Further, the inclined plate 23 is provided with a projected portion 23*a* projected to a skewed lower side at a lowermost portion thereof. Describing in details, as shown in FIG. 3, the projected portion 23*a* of the inclined plate 23 is projected to a lower face side of the recording head 20 and is opposed to the recording head 20 with a very small clearance S2 (for example, equal to or smaller than 0.5 mm) therebetween and a front end portion thereof is disposed at a height substantially the same as that of the lower face of the recording head 20. Thereby, the inclined plate 23 partitions a space S of the clearance S1 having an opening portion G of the clearance S2 between the inclined plate 23 and the recording head 20. Further, the inclined plate 23 is formed with a plurality of discharge holes 24 in a circular shape for communicating the space S and outside to penetrate a base end portion of the projected portion 23*a* and a lower face of the inclined plate 23.

Further, as shown in FIG. 2, the carriage 14 is provided with an engaging portion 14*a* projected to the right side at a right end portion of the inclined plate 23 from the carriage 14.

Also, as shown in FIG. 1, ink cartridges 25 and 26 are detachably mounted on the carriage 14. Ink is supplied from the ink cartridges 25 and 26 to the recording head 20. The ink cartridge 25 is contained with ink of black color. Further, the ink cartridge 26 is a color ink cartridge, an inner portion thereof is partitioned in three chambers and the respective chambers are respectively contained with inks of three colors of cyan, magenta and yellow.

Therefore, according to the printer 11, while the carriage 14 moves in X direction along the platen 13, ink is ejected from the recording head 20 onto the paper P by driving a piezoelectric element, not illustrated, based on printing data to thereby carry out printing.

Meanwhile, as shown in FIG. 1, a head cleaning mechanism 30 is arranged at a nonprinting region at the right side portion of the frame 12. The head cleaning mechanism 30 is provided with a capping mechanism 31, a suction pump 32 and a wiping member 33.

Describing in details, as shown in FIG. 2, a frame F of the capping mechanism 31 is provided with a slider 35 slidably supported thereby and a cap holder 36 is supported by the slider 35. The slider 35 is provided with an engaging portion 35*a* and a spring member 37 is provided to expand between the slider 35 and the frame F at a lower side thereof. Therefore, the slider 35 is pivoted to a right upper side centering on a pin 38 against the spring member 37 by engaging the engaging portion 35*a* with the engaging portion 14*a* of the carriage 14, further, when the engaging portion 35*a* is released from engagement with the engaging portion 14*a*, the slider 35 is pivoted to a left lower side centering on the pin 38 by recovery force of the spring member 37. Thereby, the cap holder 36 supported by the slider 35 can be moved in an up and down direction.

Further, a capping member 39 in a square frame shape is projected from an upper face of the cap holder 36. The capping member 39 can be opposed to the nozzle plate portion 21 of the recording head 20 at a predetermined interval therebetween and seals an opening portion of the nozzle of the nozzle plate portion 21 in accordance with a rise of the cap holder 36. Further, an opening hole 39*a* is formed at a center of the capping member 39. The capping member 39 is connected to the suction pipe 32 arranged on the lower side of the slider 36 via the opening hole 39*a*. Further, the suction pump 32 is connected to a waste ink tank 40 arranged in parallel with the platen 13 via a suction pipe, not illustrated. Therefore, by the suction pump 32, negative pressure is applied to an inner space of the capping member 39 in a state of sealing the opening portion of the nozzle of the recording head 20 by the cap holder 36 and dry (more viscous) ink is sucked from the recording head 20 and is discharged to the waste ink tank 40.

Meanwhile, as shown in FIG. 2, the wiping member 33 is provided on the left side of the cap holder 36 and extending in a direction substantially orthogonal to X direction which is a direction of moving the carriage 14 and so as to project to an upper side of the cap holder 36. The wiping member 33 is comprised of an elastic material substantially in a shape of a parallelepiped and a width L1 thereof in X direction is set to, for example, 3 mm which is larger than the clearance S2 of the opening portion G of the space S. Therefore, the wiping member 33 is brought into sliding contact with the recording head 20 and the inclined plate 23 to thereby wipe to clean respective lower faces thereof. Further, the wiping member 33 is made movable in a direction orthogonal to a paper face of FIG. 2 and when the carriage 14 is moved from a printing region to a nonprinting region of FIG. 2, the wiping member 33 is escaped from above a moving path thereof.

Next, cleaning operation of the printer 11 will be explained.

Figure 4:
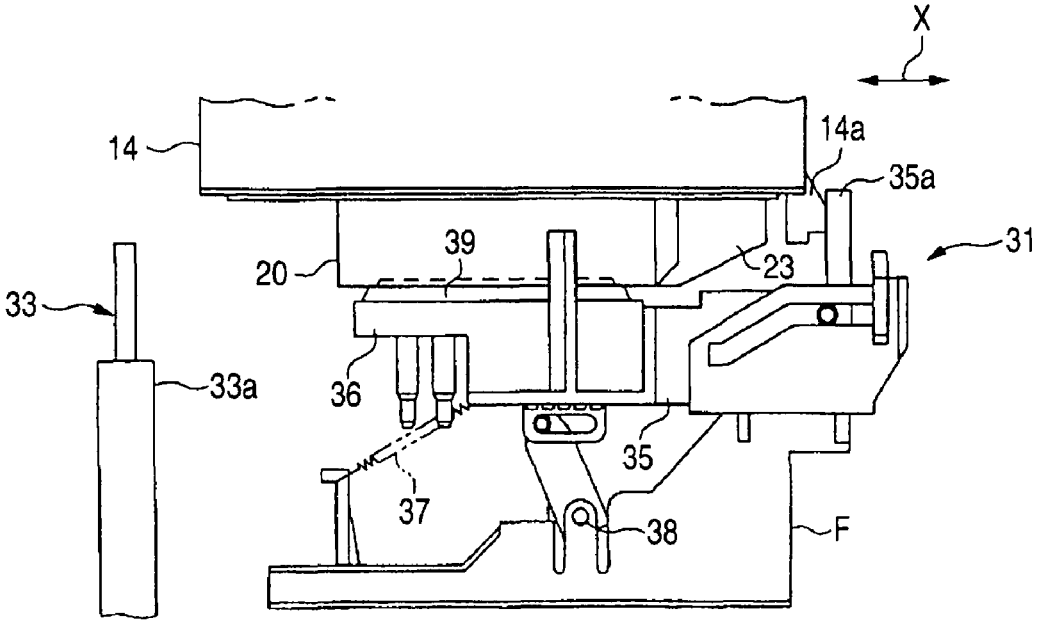
FIG. 4 is a front view of an essential portion in sucking operation showing a positional relationship between a recording head and the wiping member.

When a switch for cleaning, not illustrated, is depressed, the printer 11 starts a cleaning processing. First, as shown in FIG. 4, the printer 11 moves the carriage 14 to the right side, moves up the cap holder 36 and covers the recording head 20 by the cap member 39. Successively, the printer 11 drives the suction pump 32 to suck ink at inside of each nozzle via the opening hole 39*a* to discharge to the waste ink tank 40.

When the suction pump 32 is driven for a predetermined time period, the printer 11 stops the suction pump 32 and moves the carriage 14 to the left side. When the carriage 14 is moved to the left side, as shown in FIG. 3, the wiping member 33 projected to an upper side of the capping mechanism 31 is brought into press contact with the recording head 20 to wipe the lower face of the recording head 20. Successively, when the wiping member 33 finishes wiping the recording head 20, the wiping member 33 is moved to the inclined plate 23 to wipe the lower face of the inclined plate 23. Further, in moving from the recording head 20 to the inclined plate 23, since the lower face of the recording head 20 and the lower face of the projected portion 23*a* of the inclined plate 23 are disposed at the same height, and since the clearance S2 between the recording head 20 and the projected portion 23*a* is very small, the wiping member 33 is not inserted into the space S. Further, when ink adhered to the wiping member 33 is assumedly brought from an opening portion G into the space S, since an upper side of the space S, that is the clearance S1, is wider than an lower side of the space S, the ink is hardly moved up by the capillary force.

Further, when a large amount of ink invades the space S and ink is brought to the base end portion of the projected portion 23*a*, the ink is discharged to outside via the discharge hole 24. Further, when the wiping member 33 wipes the discharge hole 24 of the inclined plate 23, the ink discharged to outside via the discharge hole 24 is wiped along therewith.

Further, when the wiping member 33 is restored to the original shape in accordance with the inclination of the inclined face 23*f* while wiping the inclined face 23*f* of the inclined plate 23, the wiping member 33 is moved in a direction orthogonal to paper face of FIG. 2 by a moving apparatus, not illustrated, and is escaped from above the path of the carriage 14. Thereafter, when the carriage 14 is returned to the right side (to position shown in FIG. 2), the wiping member 33 is also returned onto the path of the carriage 14 again. Thereby, the cleaning operation is finished.

According to the printer 11 of the embodiment, the following effects can be achieved.

(1) According to the embodiment, the projected portion 23*a* is provided at the lowermost portion of the inclined plate 23, thereby, an upper portion of the space S between the recording head 20 and the inclined plate 23 is constituted by the wide clearance S1 and the opening portion G is narrowed as the clearance S2. That is, the very small clearance S2 is constituted at the opening portion G of the lower portion of the space S and therefore, ink is less brought into the space S via the opening portion G. Further, since the clearance S1 is large on the upper side of the space S, even when ink assumedly invades the space S, ink is not moved up by the capillary force. Further, the inclined plate 23 is arranged to the carriage 14 to provide the clearance between the inclined plate 23 and the carriage 14 and therefore, accuracy of integration may not be strict. Therefore, a concern that ink is conducted in the space S to bring about a drawback at other portion can further be reduced while facilitating to integrate the inclined plate 23.

(2) According to the embodiment, the lower face of the recording head 20 and the front end portion of the projected portion 23*a* of the inclined plate 23 are disposed substantially at the same height. That is, in moving of the wiping member 33 from the recording head 20 to the inclined plate 23, there is hardly present a stepped difference and therefore, when the wiping member 33 moves from the recording head 20 to the inclined plate 23, there is hardly scattering of ink adhered to the front end by impact of the stepped difference and the drawback by contamination can further be reduced.

(3) According to the embodiment, the clearance S1 at the lower portion of the space S is smaller than the width S1 of the wiping member 33. Therefore, there is reduced scattering of ink over a wide range by bringing the front end of the wiping member 33 into the space S2 and restoring the front end rapidly to the original shape. Therefore, a concern of invading of ink to the space S can further be reduced.

(4) According to the embodiment, the discharge hole 24 is provided at the base end portion of the projected portion 23*a* of the inclined plate 23. Therefore, when a large amount of ink invades the space S, ink can be discharged to outside from the discharge hole 24.

Second Embodiment

Next, the printer 11 as a liquid ejecting apparatus of a second embodiment embodying the present invention will be explained in reference to FIG. 5. Further, in the following respective embodiments, the same notations are attached to portions similar to those of the embodiment and a detailed explanation thereof will be omitted. Further, according to the second embodiment, only a portion related to the recording head 20 and the inclined plate 23 is different from that of the first embodiment.

Figure 5:
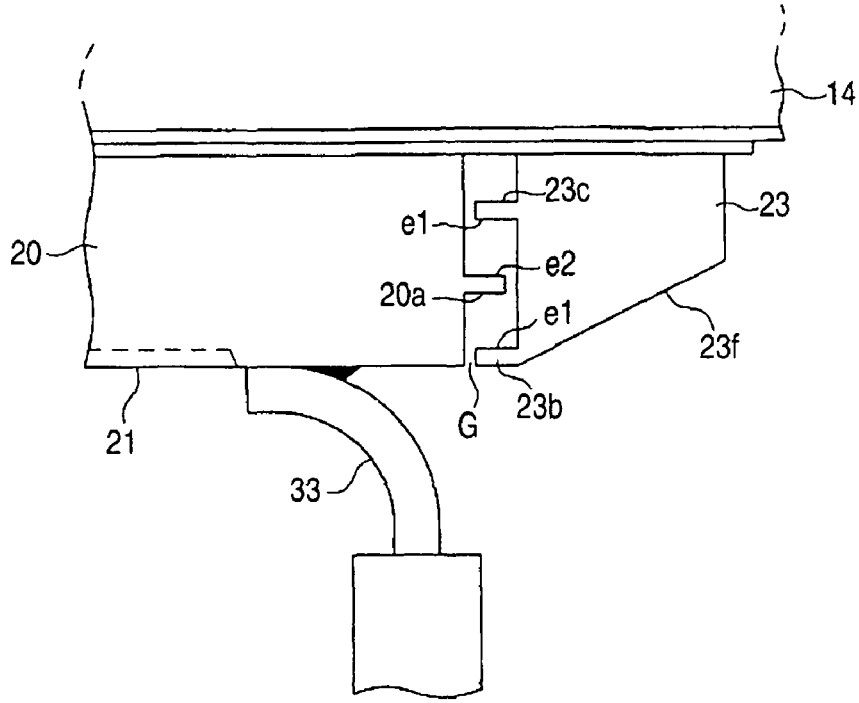
FIG. 5 is a sectional view enlarging a portion of an essential portion of a wiping member of a printer according to a second embodiment.

As shown in FIG. 5, on the left side of the inclined plate 23, rib portions 23*b* and 23*c* having a width the same as a width in Y direction thereof (in FIG. 5, direction orthogonal to paper face) are provided at an interval. The rib portion 23*b* is provided at the lowermost portion on the side of the recording head 20 in place of the projected portion 23*a* of the first embodiment. Further, on the right side of the recording head 20, a rib portion 20*a* having a width the same as the width in Y direction is provided to project to the right side. The rib portion 20*a* is disposed between the rib portion 23*b* and the rib portion 23*c* of the inclined plate 23 and is arranged at sufficient intervals from the respective rib portions 23*b* and 23*c*. Therefore, the rib portion 20*a* of the recording head 20 is arranged to cover the opening portion G between the rib portion 23*b* of the inclined plate 23 and the recording head 20 and the rib portion 23*c* of the inclined plate 23 is arranged to cover an interval between the rib portion 20*a* of the recording head 20 and the inclined plate 23, that is, to overlap end portions e1 and e2 of the respectives.

That is, ink which is going to invade via the opening portion G between the rib portion 23*b* of the inclined plate 23 and the recording head 20 is adhered to or repelled by the rib portion 20*a*. Further, even when ink passes the opening portion G, the ink is adhered to or repelled by the rib portion 23*c* between the rib portion 20*a* of the recording head 20 and the inclined plate 23.

Therefore, according to the invention, the following effects can be achieved in addition to the effects (2) and (3) of the embodiment.

(5) According to the embodiment, since the rib portions 20*a*, 23*b* and 23*c* are provided in the space S, even when ink is going to invade the space S, ink is adhered to or repelled by the rib portions 20*a*, 23*b* or 23*c* to thereby hamper ink from invading the space S. Therefore, ink is not conducted to the upper portion of the space S and a concern that ink is conducted in the space S to bring about a drawback at other portion can be reduced.

(6) According to the embodiment, the rib portion 20*a* of the recording head 20 is provided to cover the interval between the rib portion 23*b* of the inclined plate 23 and the recording head 20 and the rib portion 23*b* of the inclined plate 23 is provided to cover the interval between the rib portion 20*a* of the recording head 20 and the inclined plate 23. That is, the rib portion 20*a* of the recording head 20 and the rib portion 23*b* of the inclined plate 23 are arranged alternately such that end portions thereof overlap. Therefore, even when ink is going to invade the space S, the ink is adhered to or repelled by the rib portions 23*b* and 23*c* of the inclined plate 23 or the rib portion 20*a* of the recording head 20 and the invasion is almost prevented. Therefore, a concern of conducting ink to an upper portion of the space S can further be reduced.

(7) According to the embodiment, the rib portion 20*a* and the rib portions 23*b* and 23*c* are arranged at intervals wider than the opening portion G and therefore, the capillary force is not produced there and ink can further be presented from conducting to the upper side of the space S.

Third Embodiment

Next, a printer as a liquid ejecting apparatus of a third embodiment embodying the invention will be explained in reference to FIG. 6.

Figure 6:
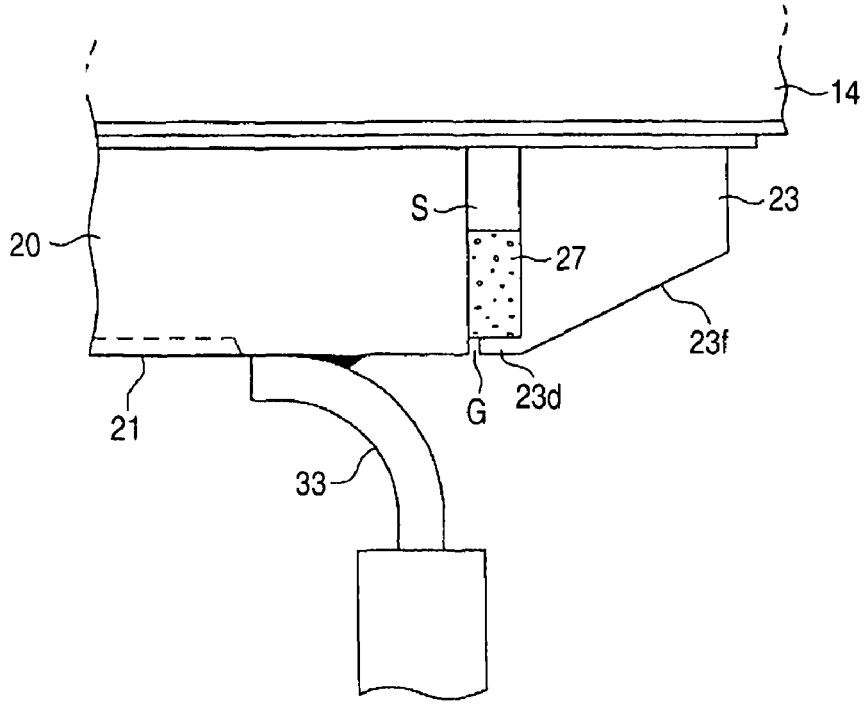
FIG. 6 is a sectional view enlarging a portion of essential portion of a wiping member of a printer according to a third embodiment.

According to the embodiment, as shown in FIG. 6, a lower end portion of the inclined plate 23 on the side of the recording head 20 is formed with a holding projection 23*d* in place of the projected portion 23*a* of the first embodiment. Further, the inclined plate 23 is provided at the carriage 14 such that the holding projection 23*d* is disposed at a height substantially the same as that of the lower face of the recording head 20.

Further, the space S is arranged with a sponge 27 as an absorbing member at the space S between the recording head 20 and the inclined plate 23. The sponge 27 includes a porous material of sponge or the like and is formed in a trapezoidal shape having a lower side a sectional shape in a free state of which is large. Therefore, the sponge 27 is supported by the holding projection 23*d* in a state of contracting a lower portion thereof, thereby, ink adsorbed by the sponge 27 gathers to the contracted lower portion by the capillary force.

That is, when ink adhered to the front end of the wiping member 33 is scattered to invade the space S, the ink is adsorbed by the sponge 27, that is, is stagnant at inside of the sponge 27. Further, the ink which is stagnant at the sponge 27 is gathered to the lower portion by the capillary force.

Therefore, according to the embodiment, in addition to the effects of (2) and (3), the following effects can be achieved.

(8) According to the embodiment, since the sponge 27 is provided at the lower portion of the space S between the recording head 20 and the inclined plate 23, ink which invades the space S is adsorbed by the sponge 27. Therefore, even when ink invades the space S, contamination is not spread to other portion of a board of the printer 11 or the like and a drawback can be reduced as small as possible from being brought about.

(9) According to the embodiment, the lower portion of the sponge 27 arranged at the space S is compressed and therefore, ink adsorbed to the sponge 27 is gathered to the lower portion by the capillary force. Therefore, ink which invades the space S is gathered to the lower portion when adsorbed by the sponge 27 and therefore, ink is further prevented from conducting to the upper portion of the space S and a drawback can further be reduced from being brought about.

A fourth embodiment of the liquid ejecting apparatus embodying the invention will be explained in reference to FIG. 1 and FIG. 7 through FIG. 15 as follows.

Figure 8:
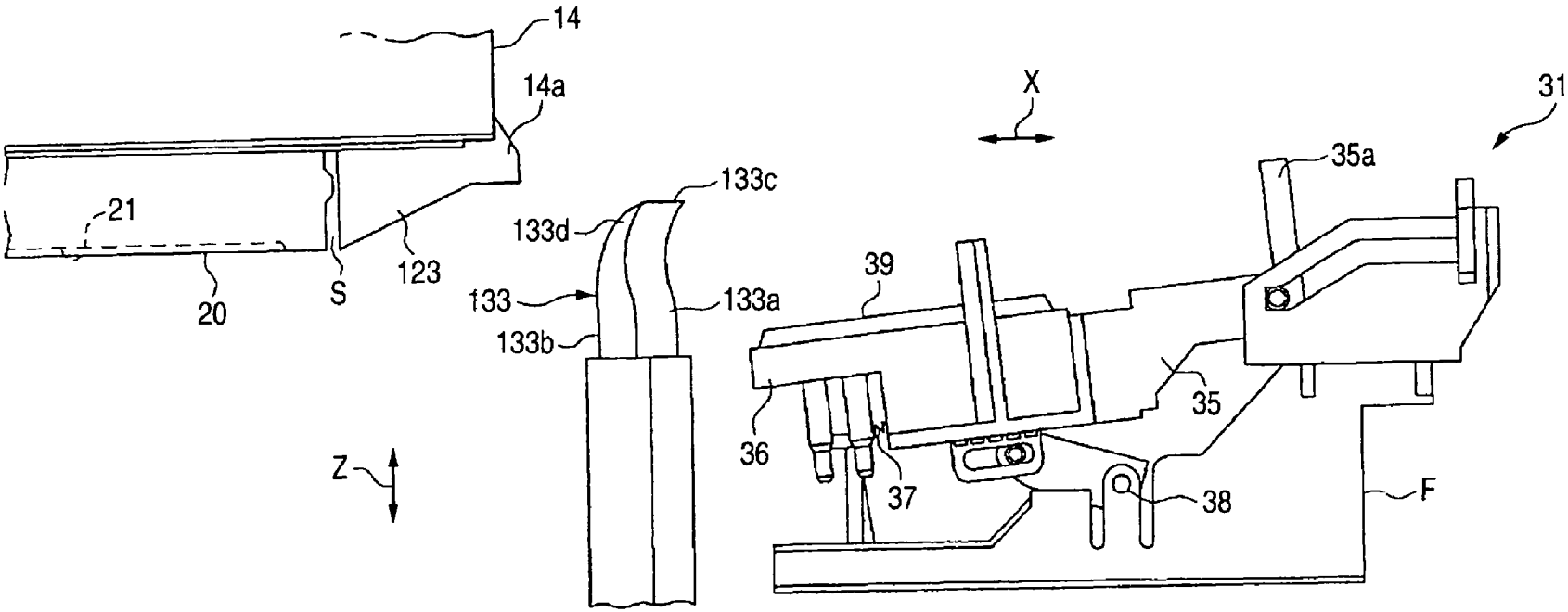
FIG. 8 is a front view of the essential portion of the head cleaning mechanism of the printer according to the fourth embodiment.

As shown in FIG. 8, the carriage 14 is attached with an inclined plate 123 at a very small clearance S from the recording head 20. A lower face of the inclined plate 123 is constituted by an inclined face and the inclined face is provided with an inclination which rises as departing from the recording head 20 in the horizontal direction (as progressing toward the right side of FIG. 8). Further, at a right end portion of the inclined plate 123 in FIG. 1, an engaging portion 14*a* projected to the right side is integrally formed with the inclined plate 123.

Figure 7:
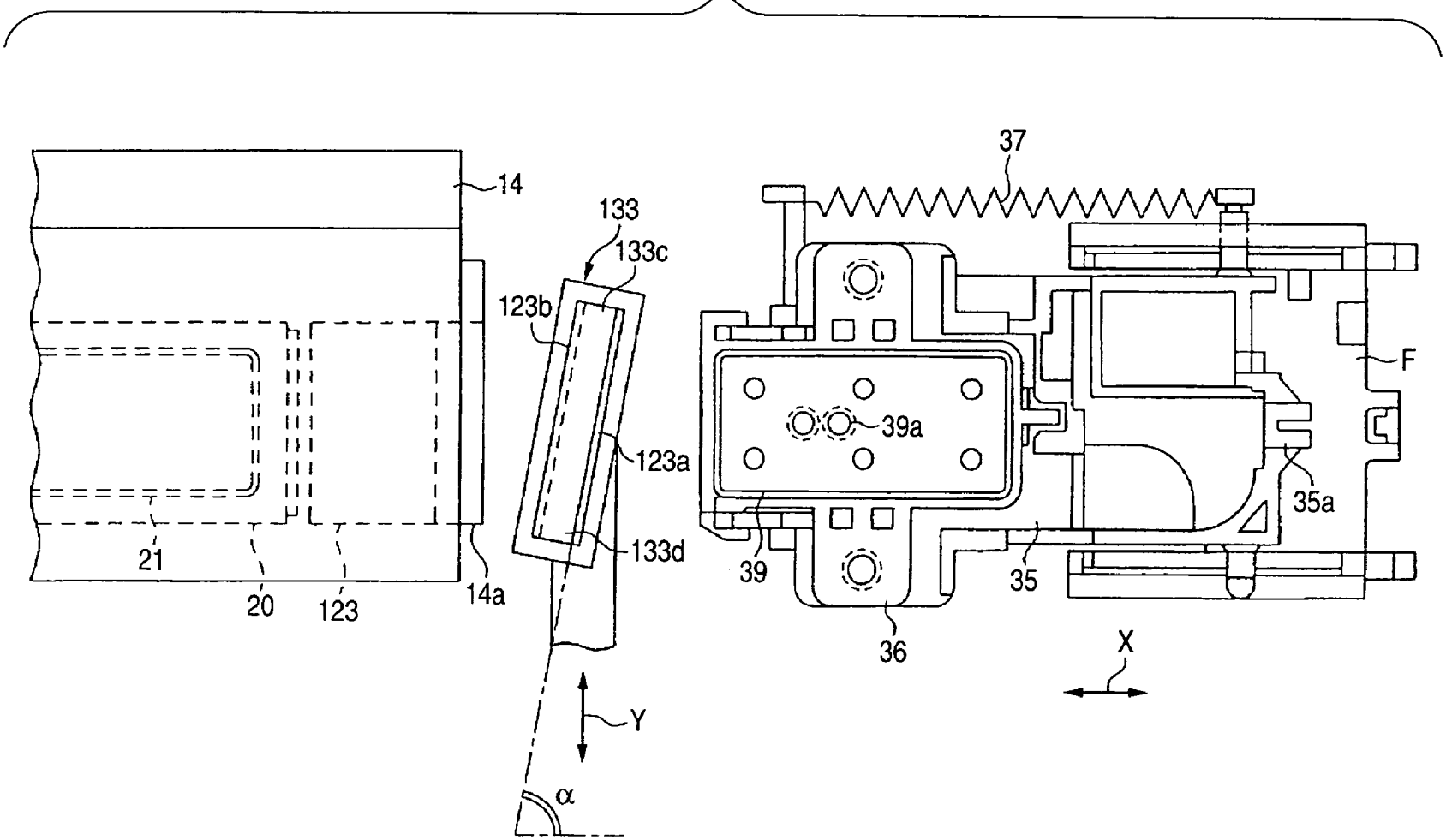
FIG. 7 is a plane view of an essential portion of a head cleaning mechanism of the printer according to a fourth embodiment.

Meanwhile, as shown in FIG. 7 and FIG. 8, the wiping member 133 is provided on the left side of the cap holder 36 to constitute a predetermined angle $\alpha$ (for example, about 60 degrees) relative to X direction which is the direction of moving the carriage 14. As shown in FIG. 7, the wiping member 133 is constituted by an elastic material with a rectangular shape in a horizontal sectional shape. The wiping member is provided to project on an upper side of the cap holder 36 as shown in FIG. 8. Therefore, the wiping member 133 is brought into press contact with the recording head 20 and the inclined plate 123 to wipe to clean lower faces thereof. Further, according to the wiping member 133, a sliding side face thereof brought into sliding contact with the recording head 20 constitutes a recessed wiping face 133*a*, a side face opposed thereto constitutes a bulged face 133*b* and a shape of a front end thereof constitutes a converging shape of substantially a V-like shape. Further, the wiping member 133 is provided with a moving apparatus, not illustrated, at a lower portion thereof and is made to be movable in a second horizontal direction (Y direction) orthogonal to the X direction by driving the moving apparatus.

Further, the printer 11 is provided with a case, not illustrated, and the case is provided with a power source switch SW and a cleaning switch CSW at a vicinity of a home position as shown in a two-dotted chain line of FIG. 1.

Figure 9:
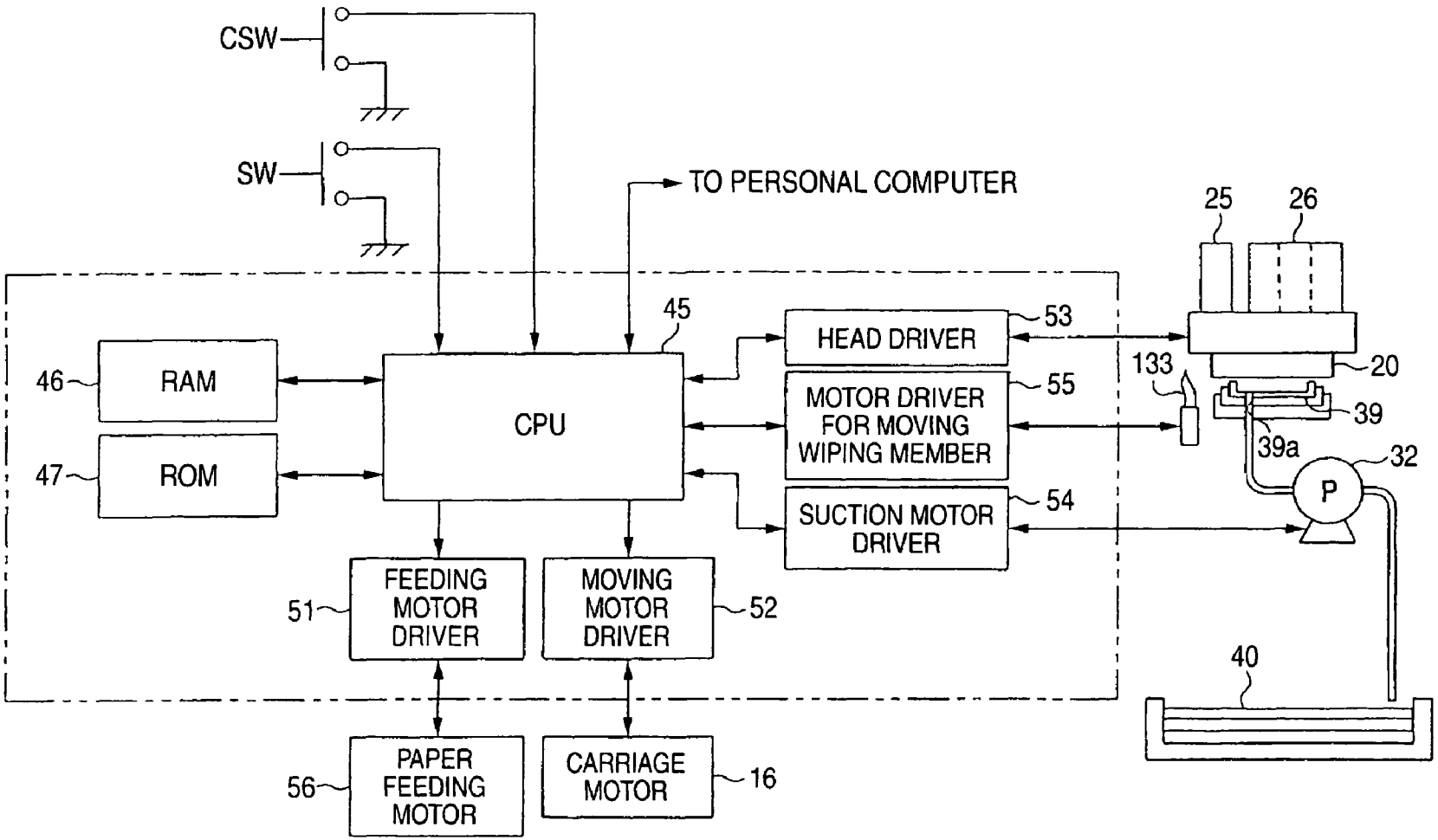
FIG. 9 is a block diagram showing an electric constitution of the printer according to the fourth embodiment.

Next, an electric constitution of the printer 11 will be explained in reference to FIG. 9.

The printer 11 is provided with CPU 45. CPU 45 is connected to RAM 46. The RAM 46 is temporarily stored with printing data. Further, the CPU 45 is connected to ROM 47, reads pertinently various programs of a printing program, a cleaning program and the like stored to the ROM 47 and carries out predetermined processings in accordance with the programs.

Further, the CPU 45 is connected to respective drivers which are a feeding motor driver 51, a moving motor driver 52, a head driver 53, a suction motor driver 54 and a motor driver 55 for moving the wiping member. The feeding motor driver 51 drives a paper feeding motor 56, not illustrated, the paper feeding motor 56 drives a paper feeding roller, not illustrated, to carry paper to guide onto the platen or discharge. Further, the moving motor driver 52 drives the carriage motor 16 to thereby move the carriage 14 in the X direction. Further, the head driver 53 makes ink ejected from the nozzle by driving the piezoelectric element, not illustrated, provided at the recording head 20.

Further, the suction motor driver 54 drives the suction pump 32 to thereby suck ink of the capping member 39 to discharge to the wasting tank 40. Further, the motor driver 55 drives in the moving apparatus, not illustrated, to thereby move the wiping member 133 in Y direction.

Meanwhile, the CPU 45 switches on or cuts off the power source of the printer in accordance with depression of the power source switch SW, and starts cleaning operation in accordance with depression of the cleaning switch CSW. Further, the printer 11 is connected to a personal computer, not illustrated, having a keyboard, a mouse and a monitor. Therefore, CPU 45 of the printer 11 receives instruction of bringing or displaying a signal of finishing of printing on the monitor via the personal computer in accordance with operation of the personal computer, not illustrated, of a user via the keyboard or the mouse.

Next, cleaning operation of the printer 11 will be explained in reference to FIG. 10 through FIG. 15.

Figure 10:
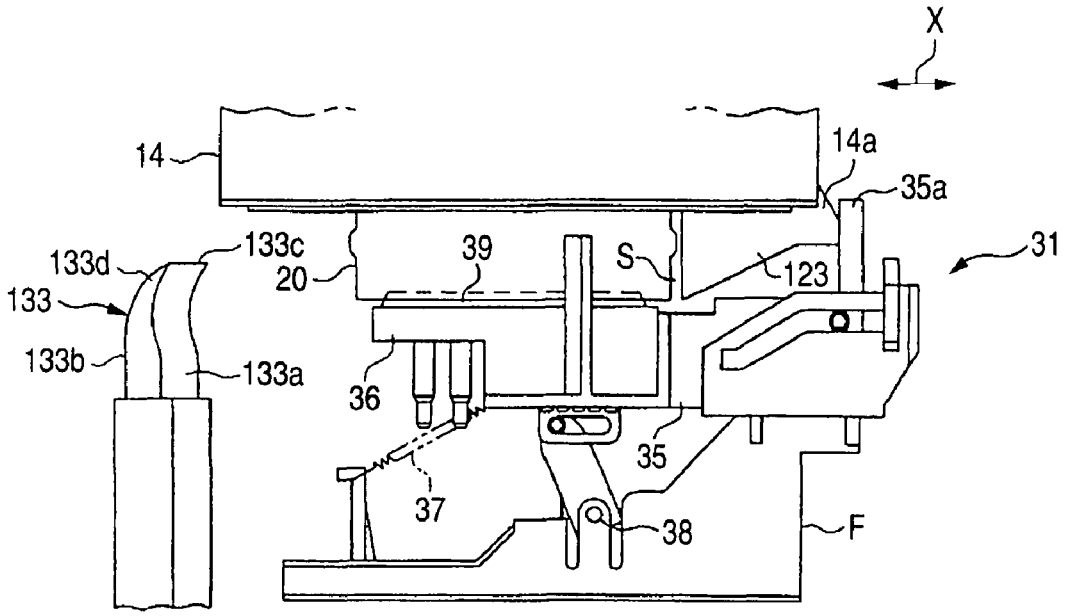
FIG. 10 is a front view of an essential portion in sucking operation showing a positional relationship between a recording head and a wiping member.
Figure 11:
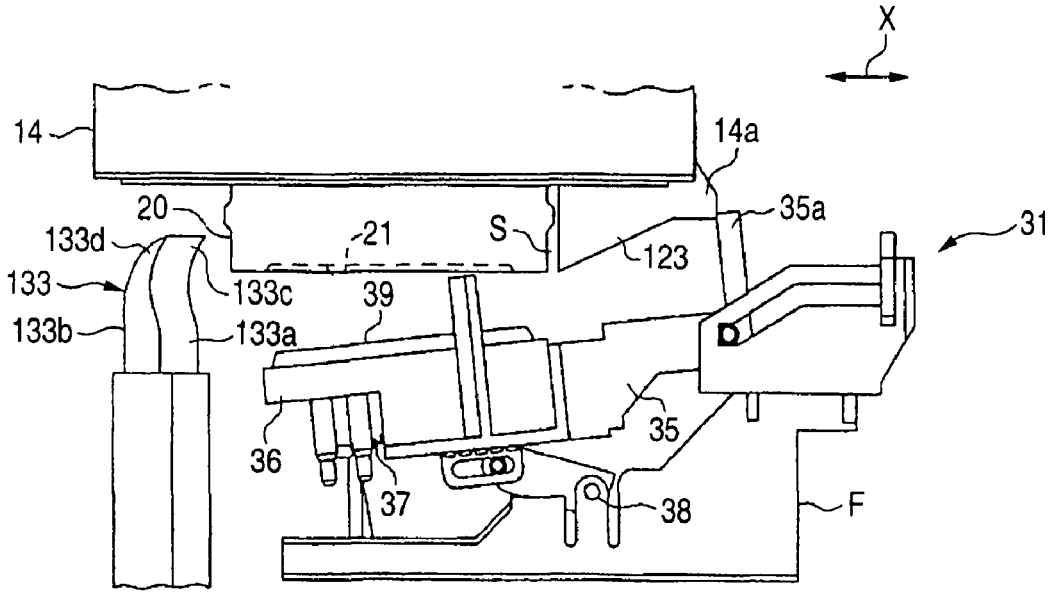
FIG. 11 is a front view of the essential portion in finishing cleaning showing a positional relationship between the recording head and the wiping member.

In a state in which operation is at standby for printing or the power source is cut, the carriage 14 is disposed at the non-printing region, as shown in FIG. 10, the engaging portion 14*a* is engaged with the engaging portion 34*a* of the slider 35, the cap holder 36 of the slider 35 rises and the capping member 39 seals the nozzle plate portion 21 of the recording head 20.

When the cleaning switch CSW is depressed from the state, the cleaning operation is started. CPU 45 makes ink of a predetermined amount sucked by the suction pump 32 from the recording head 20 by driving the suction motor driver 54. Further, substantially simultaneously therewith, CPU 45 moves the wiping member 133 to a position of wiping the nozzle plate (position indicated by a bold line in FIG. 7 and FIG. 14) by driving the motor driver 55. After sucking ink from the recording head 20, CPU 45 moves the carriage 14 to the left side by driving the moving motor driver 52 to bring about a state shown in FIG. 11. At this occasion, the slider 35 is pivoted to the left lower side by restoring force of the spring member 37 since engagement between the engaging portion 34*a* and the engaging portion 14*a* of the carriage 14 is released, the cap holder 36 is lowered and sealing of the nozzle plate 21 by the capping member 39 is released.

Figure 12:
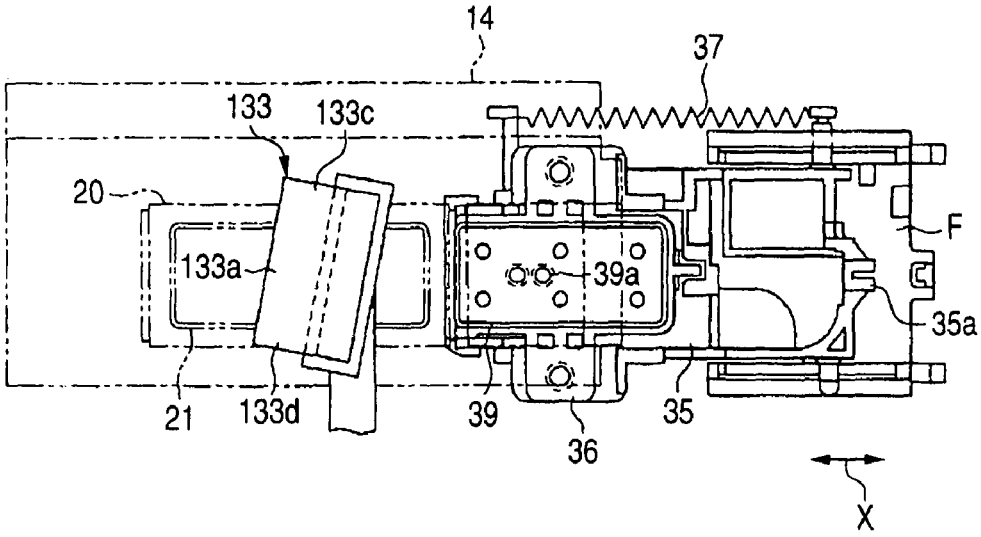
FIG. 12 is a plane view of an essential portion showing the wiping operation of the wiping member for wiping the recording head.
Figure 13:
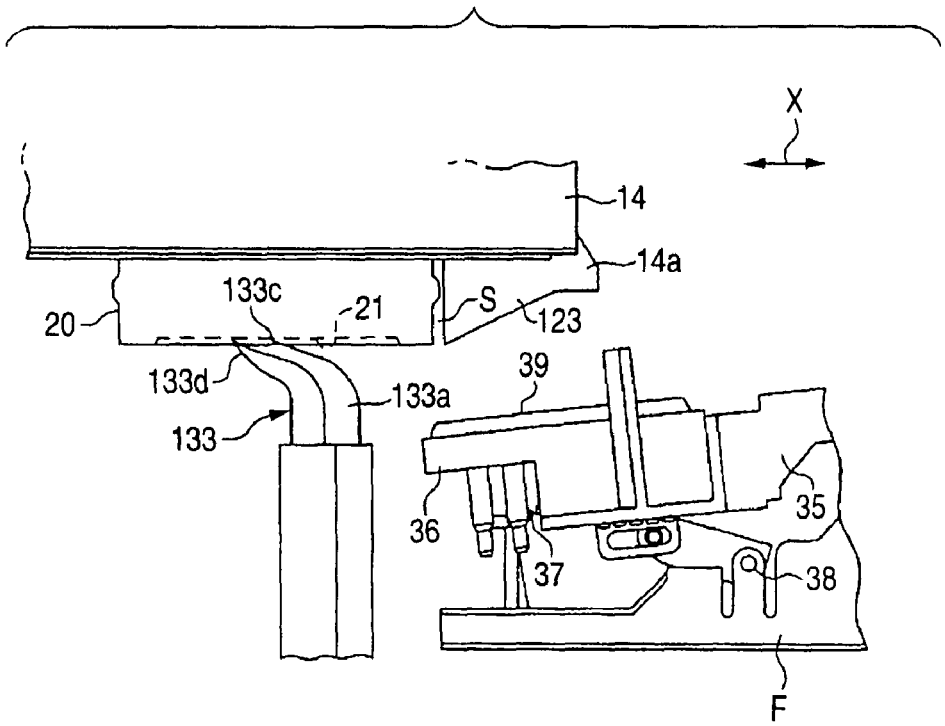
FIG. 13 is a front view of the essential portion showing the wiping operation of the wiping member for wiping the recording head.

Further, when CPU 45 moves the carriage 14 to the left side, as shown in FIG. 12 and FIG. 13, the wiping member 133 wipes the nozzle plate portion 21 by being brought into sliding contact with the lower face of the recording head 20 of the carriage 14. Further, ink wiped by the wiping member 133 flows down to the lower side of the wiping member 133 by conducting the side of the wiping face 133*a*.

Further, when the wiping member finishes wiping the recording head, the wiping member 133 is brought into sliding contact with a lower face of the inclined plate 123 successively in accordance with movement of the carriage 14 to wipe the lower face. Further, when one end portion 133*c* of the wiping member 133 moves to the inclined plate 123, other end portion 133*d* thereof is still disposed at the recording head 20 and slidingly moved to ride over the clearance S and therefore, the front end of the wiping member 133 is not inserted into the clearance S. Therefore, ink adhered to the front end is less scattered to an outer periphery thereof by releasing the wiping member 133 from a state of being brought into the clearance S to be brought into press contact therewith.

Figure 14:
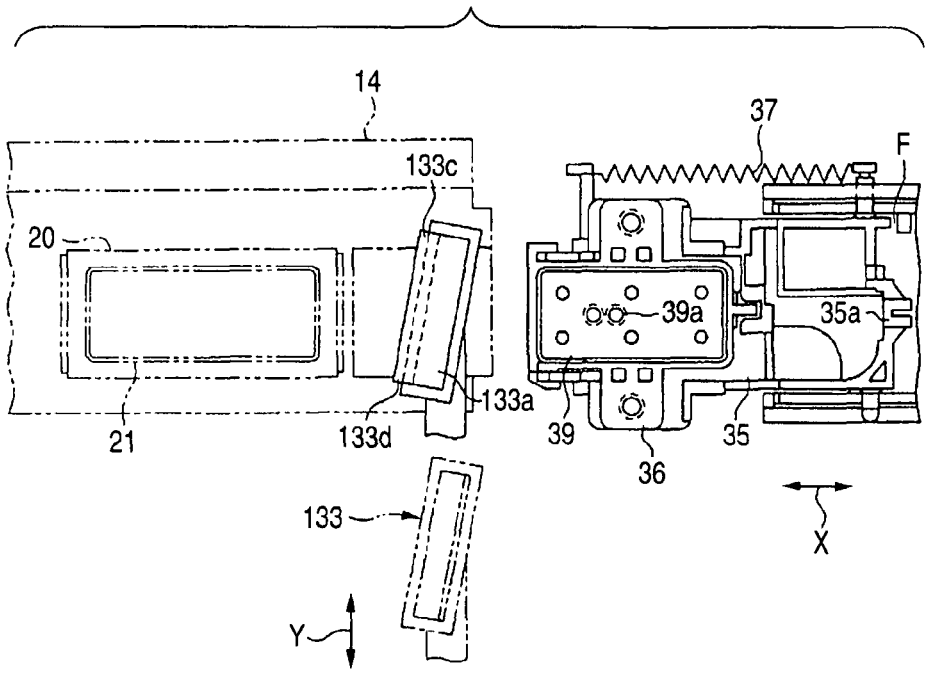
FIG. 14 is a plane view of the essential portion showing the wiping operation of the wiping member after wiping the recording head.
Figure 15:
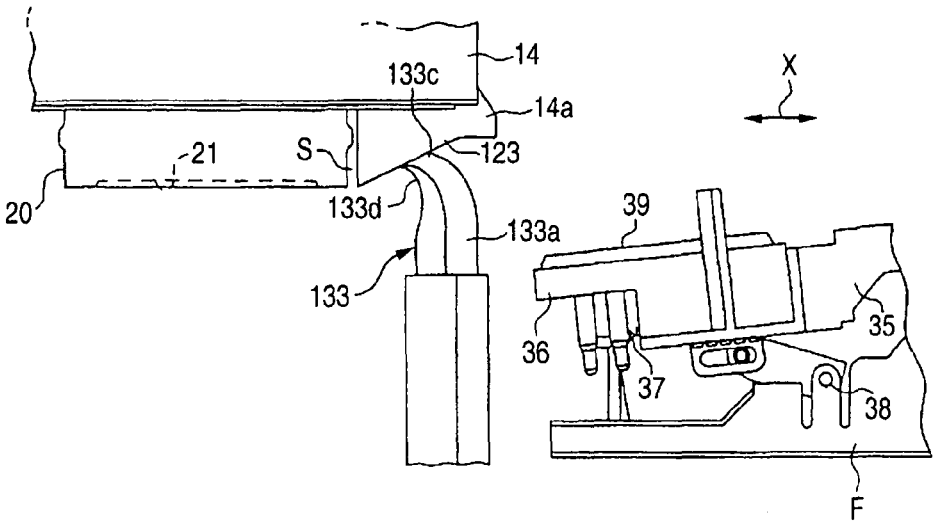
FIG. 15 is a front view of the essential portion showing the wiping operation of the wiping member after wiping the recording head.

Successively, as shown in the bold line of FIG. 14 and FIG. 15, when the wiping member 133 is brought into a state of being brought into press contact with the lower face of the inclined plate 133 after finishing to wipe the lowermost portion of the recording head 20, CPU 45 of the printer 11 stops the carriage 14 by temporarily stopping to drive the moving motor driver 52. That is, the wiping member 133 is temporarily stopped to hold in a state of being bent by being brought into press contact with the inclined plate 123. Further, during a time period in which the wiping member 133 is stopped to hold, the most portion of ink adhered to the front end by the wiping operation flows down to the lower side of the wiping member 133 mainly from the side of the wiping face 133*a*.

Further, after stopping the carriage 14 for a predetermined time period (for example, 5 seconds) in the state of bending the wiping member 133, the CPU 45 moves the wiping member 133 in Y direction as shown in an imaginary line of FIG. 14 by driving the motor driver 55. Thereby, the wiping member 133 wipes the lower face of the inclined plate 123 while moving in Y direction to be drawn from the longitudinal direction, that is, to restore the bending from the side of the other end portion 133*d*. Further, the CPU 45 finishes the cleaning processing after restoring the carriage 14 to a position shown in FIG. 11.

According to the printer 11 of the fourth embodiment, the following effect can be achieved.

According to the embodiment, the wiping member 133 wipes the lower side of the recording head 20 by moving the carriage 14 in X direction. Further, the carriage 14 is stopped to move for the predetermined time period in a state of FIG. 15 in which the wiping member 133 reaches the inclined plate 123 after wiping the recording head 20. That is, the wiping member 133 is stopped in a state of being brought into press contact with the inclined plate 123 and therefore, ink adhered to the wiping member 133 by the wiping operation sufficiently flows down to the lower side. Therefore, when the wiping member 133 is released from the state of being brought into press contact by leaving the inclined plate 123 and the front end restores, ink is hardly adhered to the front end of the wiping member 133. Therefore, even when the wiping member 133 is released from the state of being brought into press contact, ink hardly scatters to the surrounding and contamination of the inner portion of the printer 11 by ink can be reduced.

According to the embodiment, the wiping member 133 is temporarily stopped when the wiping member 133 is disposed at the inclined plate 123 provided on the right side of the recording head 20 (rear side of recording head 20). Therefore, not only a total of the recording head 20 is firmly and easily wiped but also contamination by ink adhered to the wiping member 133 can be reduced. Further, the lowermost portion of the inclined plate 123 is disposed on the side of the recording head 20 and therefore, ink adhered to the inclined plate 123 is gathered to the side of the recording head 20. Therefore, even ink which is adhere to the inclined plate 123 by scatting can sufficiently be wiped and ink can more firmly be prevented from dropping from the inclined plate 123 in printing operation.

According to the embodiment, the wiping face 133*a* of the wiping member 133 is arranged skewedly to X direction of moving the carriage 14. That is, the wiping member 133 wipes ink by being brought into press contact with the recording head 20 gradually from the one end portion 133*c* and therefore, in staring the wiping operation, load applied to the wiping member 133 can be reduced and the wiping member 133 can be used for a longer period of time. Further, since the wiping member 133 is inclined to X direction, in moving from the recording head 20 to the inclined plate 123, the front end is not inserted into the clearance S, that is, contamination of the surrounding by scattering ink adhered to the front end by bringing the front end into the clearance S and thereafter restoring the front end can be reduced.

According to the embodiment, the inclined plate 123 with which the wiping member 133 is brought into press contact is formed separately from the recording head 20 and is attached to the carriage 14 at the clearance S from the recording head 20. Therefore, the inclined plate 123 can easily be attached thereto since it is not necessary to provide the inclined plate 123 is strict tolerance.

According to the embodiment, after temporarily stopping the wiping member 133 brought into press contact with the inclined plate 123, the wiping member 133 is moved in Y direction orthogonal to X direction such that a front face thereof is constituted by the wiping face 133*a*. That is, when the one end portion 133*c* of the wiping member 133 is disposed at an end portion of the inclined plate 123 in stopping the carriage 14, even when the other end portion does not reach the end portion of the inclined plate 123, by moving the wiping member 133 in Y direction thereafter, the wiping face 133*a* wipes a total of the inclined plate 123. That is, even when movement of the wiping member 133 in X direction is reduced, more portions can be wiped.

According to the embodiment, after the wiping member 133 is stopped temporarily, the wiping member 133 is relatively moved in Y direction which is substantially the same as the longitudinal direction of the wiping member 133. Therefore, the wiping member 133 is not released in one motion from the state of being brought into press contact therewith but released gradually and therefore, ink is less scattered forcedly in a wide range and contamination thereof can be restrained to a smaller range.

According to the embodiment, the wiping member 133 is temporarily stopped in the state of being brought into press contact with the inclined plate 123 and thereafter removed in Y direction substantially orthogonal to X direction in which the front end is bent in wiping the recording head 20 and the inclined plate 123. Therefore, the front end of the wiping member 133 is not restored to a direction of being bent and a direction opposed thereto, that is, X direction but is gradually restored to the original shape from Y direction and therefore, it can be restrained that bending of the wiping member 133 is forcedly restored and ink is forcedly scattered.

According to the embodiment, the front end of the wiping member 133 is formed by the converging shape of the substantially V-like shape and therefore, by bringing the front end into press contact with the recording head 20, ink drops adhered to the surface of the recording head 20 can sufficiently be wiped.

According to the embodiment, the wiping face 133*a* of the wiping member 133 is constituted by a slightly recessed shape and therefore, when the wiping member 133 is bent to wipe ink, ink adhered to the front end of the wiping face 133*a* becomes easy to flow to the lower side. Therefore, ink can be dropped to the lower side swiftly without stagnating ink at a middle of the wiping face 133*a* of the wiping member 133.

Modified Example

Further, the respective embodiment may be modified as follows.

Although in the respective embodiments, the lower face of the recording head 20 and the lowermost portion of the inclined plate 23 is made to be flush with each other, a more or less stepped difference may be produced therebetween.

According to the first embodiment, the projected portion 23*a* for narrowing the clearance of the opening portion G of the space S is provided integrally with the inclined plate 23. In place thereof, the portion of the projected portion 23*a* may separately be formed and the projected portion 23*a* may be provided to be brought into close contact with the inclined plate 23 after providing the recording head 20 and the inclined plate 23 to the carriage 14.

According to the first embodiment, the projected portion 23*a* is provided at the inclined plate 23. Naturally, a projected portion may be provided at the recording head 20 or projected portions may be provided to both of the recording head 20 and the inclined plate 23 to partition the space S in the shape of narrowing the clearance of the opening portion G and widening the clearance of the upper portion.

Although according to the first embodiment, a plurality of discharge holes 24 in the circular shape are provided, the discharge hole 24 of other shape, for example, a slit-like shape in a rectangular shape may be provided.

Although according to the second embodiment, the rib portions for preventing invasion of ink are provided at both of the recording head 20 and the inclined plate 23, the rib portion may be provided only at the inclined plate 23.

Although according to the second embodiment, the rib portion 20*a* and the rib portion 23*b* having width the same as widths in Y direction of the recording head 20 and the inclined plate 23 are provided as projected portions, a plurality of projected portions arranged in Y direction at predetermined intervals may be provided.

Although according to the third embodiment, the sponge 27 is arranged at the space S as an absorbing material, other absorbing material (for example, cotton, paper or the like) may be arranged.

According to the third embodiment, rubber may be provided at the space S to contract in place of the sponge 27 of the absorbing material. In this case, when rubber longer than the clearance S1 of the space S is provided at the holding plate portion 23*d*, even when accuracy of attaching the inclined plate 23 is not strict, rubber can be contracted and invasion of ink into the space S can further be prevented.

Although according to the fourth embodiment, the inclined plate 123 is provided on the rear side of the recording head 20, the inclined plate 123 may not be provided. In this case, after wiping the nozzle plate portion 21 of the recording head 20, the wiping member 133 may be temporarily stopped in the state of being brought into press contact with the recording head 20. Further, in this case, when the rear side of the recording head 20, that is, a portion thereof on the rear side of the nozzle plate portion 21 is inclined upwardly, ink adhered to a rear end portion thereof gathers to the side of the recording head 20 which is lower than the rear side and therefore, even when the wiping member 133 does not wipe a total of the rear end portion, the wiping member 133 can sufficiently wipe the recording head 20.

Although according to the fourth embodiment, a description is given of the printer 11 in which the ink cartridges 25 and 26 are mounted on the carriage 14, naturally, the embodiment may be applied to the printer 11 which is not mounted with the ink cartridges 25 and 26 at the carriage 14 but is fixed therewith.

According to the fourth embodiment, when the lower face of the recording head 20 is wiped, the carriage 14 is moved in X direction without moving the wiping member 133 and after the wiping member 133 is temporarily stopped, the carriage 14 is stopped and the wiping member 133 is moved in Y direction. In stead thereof, the wiping member 133 may be moved in X direction and Y direction without moving the carriage 14 and the carriage 14 may be moved also in Y direction. That is, so far as the carriage 14 mounted with the recording head 20 and the wiping member 133 are moved relative to each other, either thereof may be moved. Further, when the wiping member 133 is stopped to hold relative to the carriage 14, the carriage 14 or the wiping member 133 which is actually moved may be stopped.

Although according to the respective embodiments, a description is given that the wiping member 33 and 133 moves in a Y direction by driving the moving apparatus, not illustrated, the wiping member 33 and 133 may moves in a vertical direction shown in FIG. 8 as an arrow Z by driving a moving apparatus. In other word, when the lower face of the recording head 20 is wiped, the wiping member 33 and 133 may move up to wipe the recording head 20, and after the wiping member 33 and 133 is temporarily stopped, the wiping member 33 and 133 may move down so as to being far from the recording head 20. Also, when the lower face of the recording head 20 is wiped, the wiping member 33 and 133 may move upwardly at a slant to wipe the recording head 20, and after the wiping member 33 and 133 is temporarily stopped, the wiping member 33 and 133 may move downwardly at a slant so as to being far from the recording head 20.

Although according to the respective embodiments, an explanation has been given of a printer ejecting ink (printing apparatus including facsimile, copier or the like) as a liquid ejecting apparatus, the embodiment may be a liquid ejecting apparatus ejecting other liquid. For example, the embodiment may be a liquid ejecting apparatus for ejecting an electrode material or a color material used in fabricating a liquid crystal display, an EL display and a face luminescent display, a liquid ejecting apparatus for ejecting an organic substance of a living body used in fabricating a biochip, or a sample ejecting apparatus as a fine pipet.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A liquid ejecting apparatus comprising:

a liquid ejecting head, having a plurality of nozzles for ejecting a liquid drop formed at a lower face thereof;

a wiping member, wiping an opening portion of the nozzle; and an inclined member, formed with an inclined face inclinedly rising away from the liquid ejecting head, wherein:

a space is provided between the liquid ejecting head and the inclined member, a projected portion is provided on at least one of the liquid ejecting head and the inclined member such that an opening that is a first clearance which corresponds to a lower side of the space is smaller than a second clearance which correspond to an upper side of the space, an absorbing member is arranged in the second clearance and a lower portion of the absorbing member is compressed, the wiping member is not inserted in the first clearance, and when liquid attached to the wiping member is inserted in the space from the first clearance, the liquid is not moved up in the space by capillary force.

2. The liquid ejecting apparatus as set forth in claim 1, wherein a lower face of the inclined member on a side of the liquid ejecting head and a lower face of the liquid ejecting head on a side of the inclined plate are substantially flush with each other.

3. The liquid ejecting apparatus as set forth in claim 1, wherein the absorbing member is comprised of a porous material; and the absorbing member is arranged in the second clearance by contracting a lower portion thereof.

4. The liquid ejecting apparatus as set forth in claim 1, wherein the absorbing member is in contact with both of the liquid ejecting head and the inclined member.

* * * * *